United States Patent [19]

Eichinger et al.

[11] 4,409,904

[45] Oct. 18, 1983

[54] DOUBLE-AXLE DRIVE FOR RAILWAY TRUCKS OF RAILRAOD VEHICLES

[75] Inventors: Johann Eichinger, Vaterstetten; Franz Parzl; Wolfgang Schulz, both of Munich, all of Fed. Rep. of Germany

[73] Assignee: Carl Hurth Maschinen- und Zahnradfabrik GmbH & Co., Munich, Fed. Rep. of Germany

[21] Appl. No.: 255,964

[22] Filed: Apr. 20, 1981

[30] Foreign Application Priority Data

Jul. 15, 1980 [DE] Fed. Rep. of Germany ..... 3026756

[51] Int. Cl.[3] ..... B61C 9/44; B61C 9/50; B61C 9/52

[52] U.S. Cl. ..... 105/131; 105/135; 105/136

[58] Field of Search ..... 105/131, 135, 136

[56] References Cited

U.S. PATENT DOCUMENTS

| | | | |
|---|---|---|---|
| 529,671 | 11/1894 | Van Depoele | 105/131 X |
| 1,182,952 | 6/1916 | Sundh | 105/131 X |
| 1,679,469 | 8/1928 | Geiger | 105/131 |
| 3,453,971 | 7/1969 | Ishizawa | 105/131 |
| 3,859,929 | 1/1975 | Korn et al. | 105/131 |
| 4,095,530 | 6/1978 | Korber et al. | 105/131 |
| 4,135,453 | 1/1979 | Koch et al. | 105/131 |
| 4,278,027 | 7/1981 | Eichinger et al. | 105/131 |

FOREIGN PATENT DOCUMENTS

| | | | |
|---|---|---|---|
| 838452 | 4/1952 | Fed. Rep. of Germany | 105/131 |
| 2332281 | 1/1975 | Fed. Rep. of Germany | 105/131 |
| 964373 | 4/1951 | France | 105/131 |
| 279158 | 3/1952 | Switzerland | 105/131 |

*Primary Examiner*—Robert B. Reeves
*Assistant Examiner*—Howard Beltran
*Attorney, Agent, or Firm*—Flynn, Thiel, Boutell & Tanis

[57] ABSTRACT

A double-axle drive for trucks of a railway vehicle has a drive motor with a drive shaft extending parallel to the longitudinal axis of the vehicle and a respective gearing mechanism engaged with each end of the drive shaft. Each gearing mechanism is drivingly coupled to a hollow shaft which concentrically surrounds a respective wheel-set axle. The wheel-set axle and hollw shaft are coupled by elastic couplings provided at each end of the hollow shaft. Each elastic coupling includes a coupling half mounted on the hollow shaft and a coupling half axially aligned therewith mounted on the axle. One coupling half has a plurality of radially extending pins and the other has a plurality of radially extending arms, the pins and arms being positioned alternately in a rotational direction. Elastically yieldable elements are provided between the pins and arms, are initially tensioned, and engage surfaces on the pins and arms which are not parallel to the wheel-set axle.

4 Claims, 9 Drawing Figures

DOUBLE-AXLE DRIVE FOR RAILWAY TRUCKS OF RAILRAOD VEHICLES

FIELD OF THE INVENTION

This invention relates to a double-axle drive for railway trucks of railroad vehicles having a motor with a drive shaft which rotates about an axis parallel to the longitudinal axis of the vehicle, is positioned between the wheel-set axles, and drives the wheel-set axles through respective gear arrangements which are connected to opposite ends of the drive shaft, each gear arrangement having on the driven side thereof a hollow shaft which substantially concentrically surrounds the respective wheel-set axle and which is connected at each of its two ends through an elastic coupling to the wheel-set axle, the entire drive system being supported on the two axles by four such couplings.

BACKGROUND OF THE INVENTION

Drives of the foregoing type, which are also known as suspended drives, have been known for a long period of time. German Pat. No. 838 452 has as its subject matter a drive of the described type in which the elastic coupling is formed by a rubber disk which surrounds the wheel-set axle and is connected, for example, vy vulcanizing, on one side with a disk-shaped flange which is secured on the hollow shaft and on the other side with a disk-shaped flange which is mounted on the wheel-set axle. (Here and hereinafter, references to "rubber" include plastics and similar materials with comparable characteristics.)

All double-axle drives of the above-described type are characterized by the elastic couplings having to not only transmit torque, but also to absorb the reaction moment of the motor and to carry resiliently the entire weight of the drive aggregate. In the case of the design of the elastic coupling which is discussed here, the rubber is stressed mainly by shear stresses through the weight and the mass forces which occur during the driving operation, namely in a plane which lies perpendicular to the wheel-set axle. In order not to permit the drive unit to sag too much with respect to the wheel-set axle, the rubber disk must be relatively narrow and hard. Through this, however, the negative effects of the shear stresses are increased and the lateral spring action, in the direction of the wheel-set axle, is worsened. A further important disadvantge is that the wheels must be removed from the axles during replacement of the rubber disks.

This disadvantage, which very much interferes with operation, is avoided by a coupling with divided elements, as is known for example from German OS No. 23 32 281. A hub mounted on the hollow shaft and a hub mounted on the wheel-set axle each have a number of radially outwardly extending arms which are arranged alternately, one behind the other, and are each placed between two arms of a square-shaped elastic block. The elastic blocks can be individually removed and inserted without the wheels having to be removed from the axles. This type of coupling is very stiff in the plane perpendicular to the wheel-set axle. In a lateral direction it is softer than the construction with the rubber disk, but the blocks are exposed to shear stresses. A further disadvantage is that the elastic blocks, during installation, must first be initially tensioned in an auxiliary mechanism so that they can be moved into the space between the arms, which space corresponds with the initial tension required for operation.

Therefore, the basic purpose of the invention is to produce a double-axle drive of the above-described type which does not have the mentioned disadvantages and thus is easy to manufacture and service, the elastic elements of which are exposed to little or no shear stress.

SUMMARY OF THE INVENTION

This purpose is attained with a design for the elastic couplings of the drive in which each elastic coupling includes a plurality of radially projecting pins on one coupling half and a plurality of radially projecting arms on the other coupling half, the pins and arms being arranged to alternate in a rotational direction, and includes elastically yieldable elements which are arranged between surfaces on the pins and arms, which are not parallel to the associated wheel-set axle and are initially tensioned.

It is possible with this design to construct the elastically yieldable elements to have substantially optimum spring load deflection curves. In particular, it is possible to make the elements stiff for movements occurring in the direction of the wheel-set axle but with a soft springiness for movements occurring in the peripheral direction of the coupling. At least three elements are necessary in each coupling for a balanced operation, but since the elements should not be stressed to their limits, preferably not less than six rubber elements are provided in each coupling.

Possible forms for the shape of the elastically yieldable elements include a cylindrical sleeve, an arcuate block and a V-shaped block. A coupling with cylindrical sleeve requires a relatively wide space which is not always available. Therefore, the arcuate blocks, or because of the simpler mounting, the V-shaped blocks, are preferred. The V-shaped blocks, due to positive engagement with the pins and arms, do not require an additional safety mechanism to prevent a lateral shift. The arcuate or V-shaped blocks can, compared with the cylindrical sleeves, be varied in their cross-sectional shape to achieve the axial spring stiffness desired for a particular use.

Due to this shape, the arcuate or V-shaped blocks can receive their initial tension only in an assembled condition. Assembly is made easier and the need for additional apparatus is avoided when the associated bearing surfaces on the pins and the arms are inclined with respect to one another at a slight angle and the elastically yieldable elements are wedge-shaped with the same angle. With this, uniform deformation and thus uniform tension in the rubber during axial dislocations is achieved, as is a precise initial tensioning of the elements during installation, without which auxiliary means would have to be used.

To avoid damage to the elements and also to make installation easier, it is advisable to design the elastically yieldable elements as a rubber part which is vulcanized between two metal parts. It can also be advantageous, for the purpose of achieving optimum spring characteristic values, to form the elements of at least two vulcanized rubber parts having between them a metal part.

Securing the elastically yieldable elements against movement in a radial direction is advantageously effected with cover plates which are secured on the end surfaces of the pins and arms.

The inventive double-axle drive offers, compared with conventional constructions, a number of advantages, including:

- The elastically yieldable elements are stressed by the torque to be transmitted and by the weight of the motor-gearing-aggregate substantially with compression forces and with only minimal shear stresses.
- The replacement of individual elastically yieldable elements can be effected without demounting the railroad truck and without removing the motor, gearings and/or axles and wheel sets.
- During an angular deflection only small restoring forces occur, through which great security against derailing is given.
- The restoring forces can be adapted to meet particular requirements through suitable construction of the elastically yieldable elements.

BRIEF DESCRIPTION OF THE DRAWINGS

The invention is discussed in connection with exemplary embodiments which are illustrated in FIGS. 1 to 8, in which.

DETAILED DESCRIPTION

Figure 1:
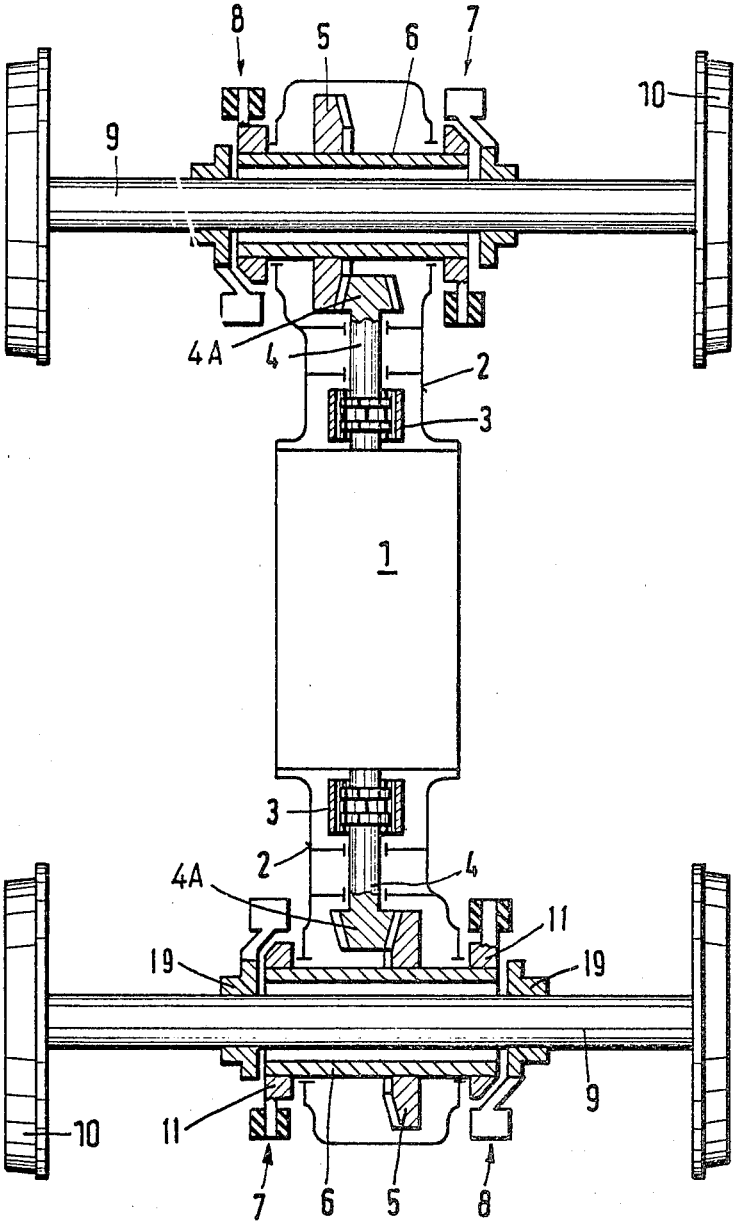
FIG. 1 is a top view, partially in section, of a simplified embodiment of a double-axle drive.

A pinion gear 4A is connected to each shaft of a double output shaft drive motor 1, the axis of rotation of which extends parallel to the longitudinal axis of a not illustrated truck for a railroad vehicle, the housing for the pinion gear 4A being identified by the reference numeral 2. The transmission of power from the motor 1 onto the pinion gear shaft 4 of the gearing arrangement occurs through a suitable coupling 3 to balance angle deviations and axial misalignments between motor and gearing caused by the manufacturing process, and the coupling 3 may be, for example, a toothed coupling. The pinion gear 4A engages a bevel gear 5 which is mounted on a hollow shaft 6 and fixed against rotation with respect thereto, for example by screwing and pinning it on a flange or enlargement of the hollow shaft 6. The hollow shaft 6, like the pinion shaft 4, is rotatably supported in a conventional and therefore not illustrated manner; however, it is not axially movable in the housing 2. The hollow shaft 6 projects laterally out of the housing 2 on both sides thereof enough to facilitate a fixed mounting thereon of first coupling halves 11 of linkage couplings 7 and 8, the coupling halves 11 being fixed against rotation and axial movement with respect to the shaft 6. Details of the couplings 7 and 8 will be described below. Associated second coupling halves 19 are mounted, also fixed against a relative rotation and an axial movement, on a wheel-set axle 9. The wheel-set axle 9 extends coaxially through the hollow shaft 6 and carries at its axial ends drive wheels 10 for the railroad vehicle. In the unloaded condition, the radial play between the inner wall of the hollow shaft 6 and the outer surface of the wheel-set axle 9 is sufficient for the elasticity requirements of the drive system in consideration of its weight and the mass acceleration which occurs during the driving operation on the one hand and the resiliency possibilities of the elastic joint coupling on the other hand, with the addition of a certain safety factor. The mounting of the wheel set in the railroad truck is not illustrated, just as a disk brake which is arranged if desired between an elastic joint coupling on each wheel-set axle and the adjacent drive wheel 10 is not illustrated. These elements are known and are of no importance for the invention.

Figure 2A:
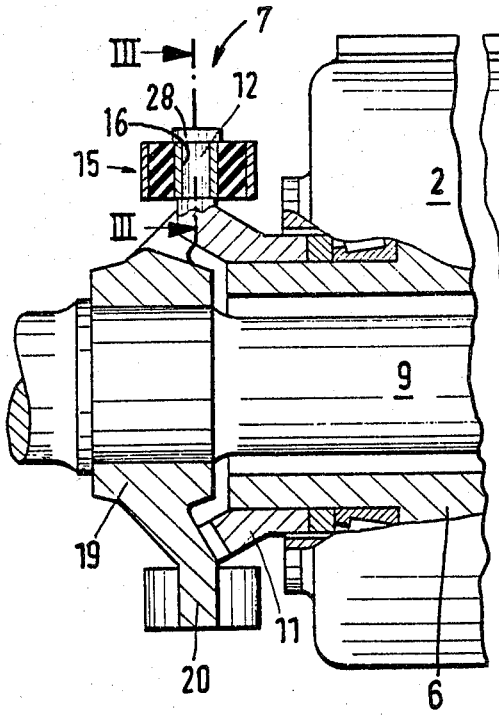
FIGS. 2A and 2B are a longitudinal fragmentary view of alternate couplings of the gearing arrangement of FIG. 1 in an enlarged scale.
Figure 2B:
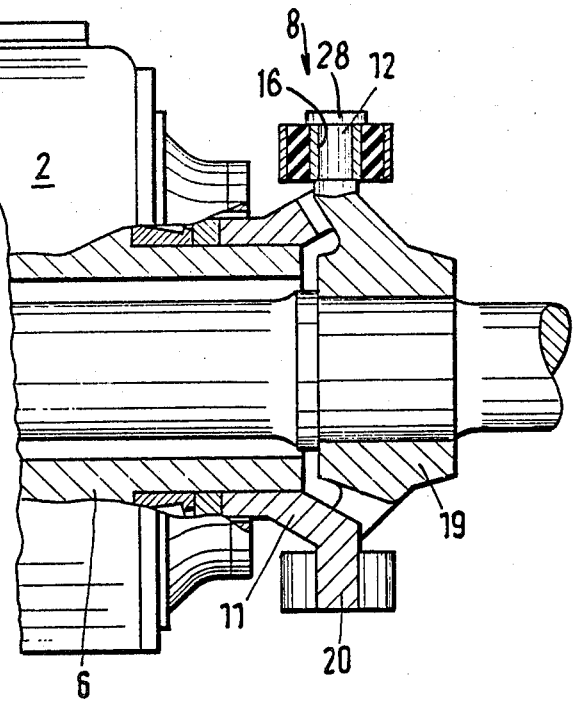
Figure 3:
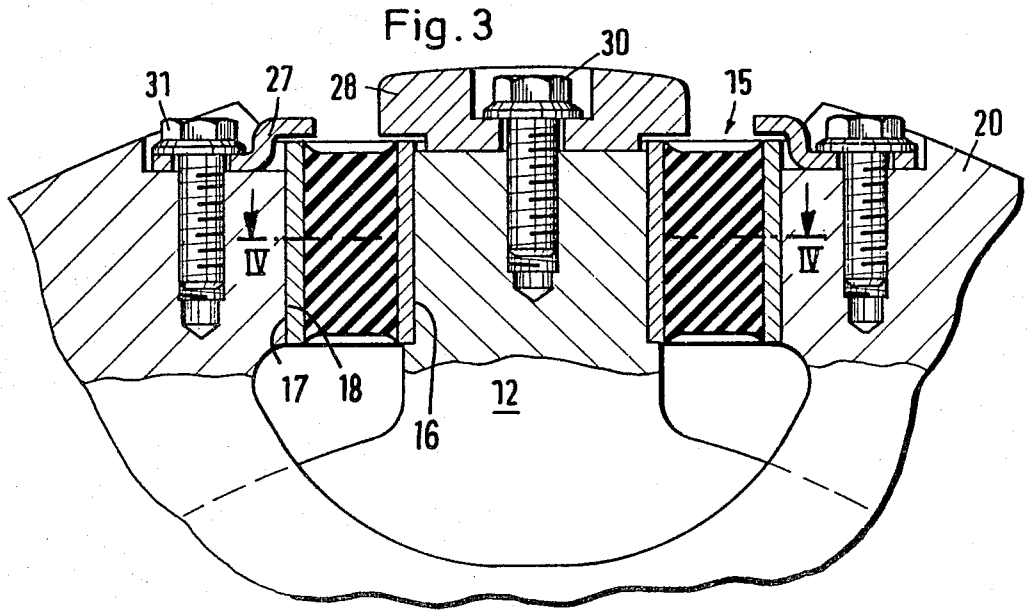
FIG. 3 is a sectional view taken along the line III—III of FIG. 2.
Figure 4:
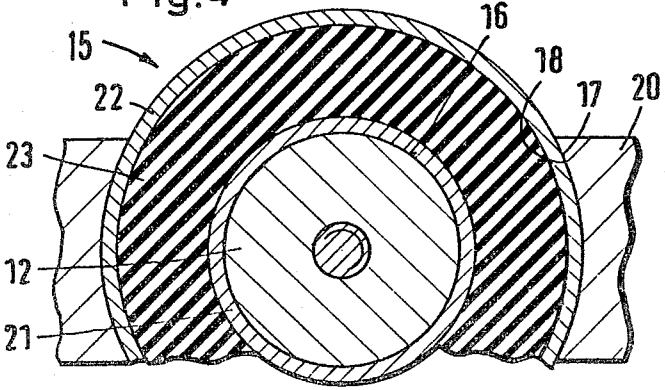
FIG. 4 is a sectional view taken along the line IV—IV of FIG. 3.

Details of the linkage couplings 7,8 (FIG. 1) can be seen in FIGS. 2, 3 and 4. The first coupling half 11 is mounted, for example by a forced fit, on the hollow shaft 6 so as to be fixed against rotation and axial movement with respect thereto. Pins 12 project radially outwardly from the hub of the coupling half 11. The hub and the pins are a single integral element in the illustrated embodiment, but the pins could alternatively be inserted and secured individually in a hub. The pins 12 are each received in the central opening 16 of an elastically yieldable annular sleeve 15. The sleeves 15 will be discussed in greater detail below. The outer surfaces 17 of the sleeves 15 engage suitably curved bearing surfaces 18 provided on radially extending arms 20 of the second coupling half 19. This arrangement is illustrated by all the couplings in FIG. 1 and by the coupling in FIG. 2A. Alternatively, the pins 12 can be arranged on the second coupling half 19 and the arms 20 can be arranged on the first coupling half 11, which arrangement is illustrated by the coupling in FIG. 2B. The second coupling halves 19 are securely mounted on the wheel-set axle 9 so as to be fixed against rotation and axial movement with respect thereto, for example with a forced fit. The first and second coupling halves 11 and 19 are substantially rotation-symmetric parts which are aligned axially with one another. The pins 12 and the arms 20 which respectively project radially outwardly from the first and second coupling halves 11 and 19 rotationally alternate with one another. In other words, each pin 12 is disposed between two adjacent arms 20, and vice versa. In the exemplary embodiment, the sleeves 15 have only a portion of their outer surfaces 17 engaging the surfaces 18 on the arms 20. It would alternatively be possible to connect the arms 20 with each other with circumferentially extending webs which engage the entire outer surface of each sleeve 15, but this construction requires more axial space on the shaft 6 and requires individually inserted pins 12.

Each coupling 7 and 8 requires at least three angularly spaced sleeves 15 in order to prevent a large part of the weight of the driving aggregate and the mass acceleration during the driving operation from applying a thrust load to the elastically yieldable elements, as thrust loads result in the elastic material, for example, rubber, becoming detached from the metal parts and being quickly destroyed. In order to eliminate, as much as possible, such thrust loads, at least six sleeves 15 are preferably provided in each coupling 7,8.

Figure 5:
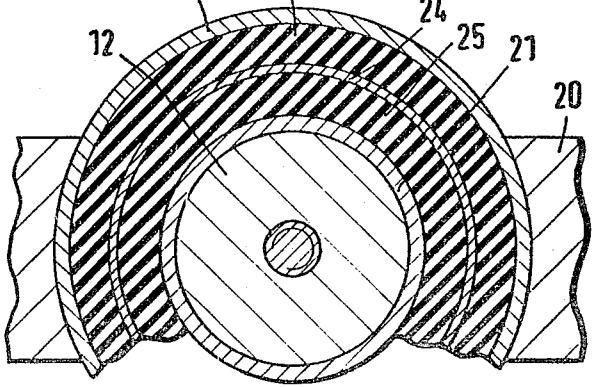
FIG. 5 is a sectional view similar to FIG. 4 and illustrating a different embodiment of an elastically yieldable element.

As illustrated in FIGS. 2 to 4, each elastically yieldable sleeve 15 consists of an annular metallic inner part 21, an annular metallic outer part 22, and a rubber ring 23 which is vulcanized therebetween and is under an initial tension. The characteristics and dimensions of the sleeve elements can be preselected to meet different operating conditions, including the shape of the rubber ring which may, for example, be of rectangular cross section or may have curved, double-inclined, or similarly shaped external surfces. FIG. 5 illustrates an alternative embodiment of the elastically yieldable sleeve 15 in which the shear stresses occurring in the rubber are kept very low by a division of the rubber ring. Specifically, the sleeve 15 consists of an annular metallic inner part 21, an annular metallic intermediate part 24, an annular metallic outer part 22 and two rubber rings 25 and 26 which are respectively vulcanized between the inner and intermediate parts and the intermediate and outer parts and are under an initial tension. Here too, characteristics and dimensions of the elements of the sleeve can be preselected to meet various operating conditions. Of course, other forms of the elastically yieldable sleeves can also be used, for example recesses can be provided in the rubber rings in order to have available a full rubber cross section in the rotational direction of the coupling, but only a reduced cross section in the transverse direction.

Cover plates 28 are mounted on the outer end surfaces of the pins 12 and holding pieces 27 are mounted on the arms 20 with screws 30 and 31, respectively. The structure which is necessary for securing the screws 30 and 31 against an independent loosening, for example safety sheets, are known and therefore not illustrated.

Figure 6:
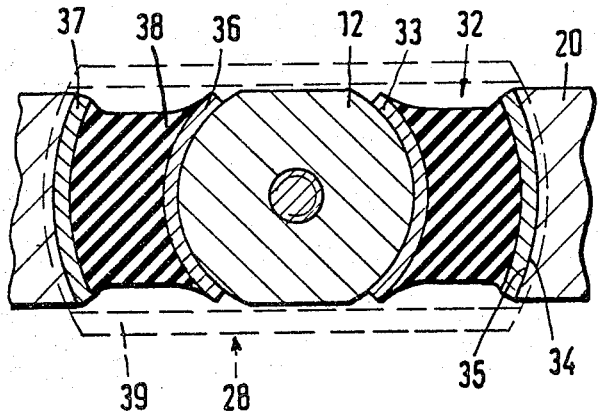
FIG. 6 is a sectional view similar to FIG. 4 and illustrating a further embodiment having a divided elastically yieldable element.

A different construction of the elastically yieldable elements is illustrated in FIG. 6. In place of a single substantially annular sleeve, a pair of elastically yieldable blocks 32 are provided. They each have an arcuate inner surface 33 which engages a pin 12 and an arcuate outer surface 34 which engages a rounded surface 35 on one of the arms 20. The blocks 32 each consist of an arcuate inner and an arcuate outer metal part 36 and 37 and an arcuate rubber part 38 which is vulcanized therebetween. The inner and the outer surfaces 33 and 34 are coaxial in the illustrated embodiment. In order to achieve different resiliency characteristics, however, different centerpoints could be provided for the arcuate surfaces 33 and 34. Bars 39 which extend downwardly from the cover plates 28 can be provided on opposite sides of the blocks 32, as shown by broken lines in FIG. 6, to prevent the blocks 32 from shifting laterally.

Figure 7:
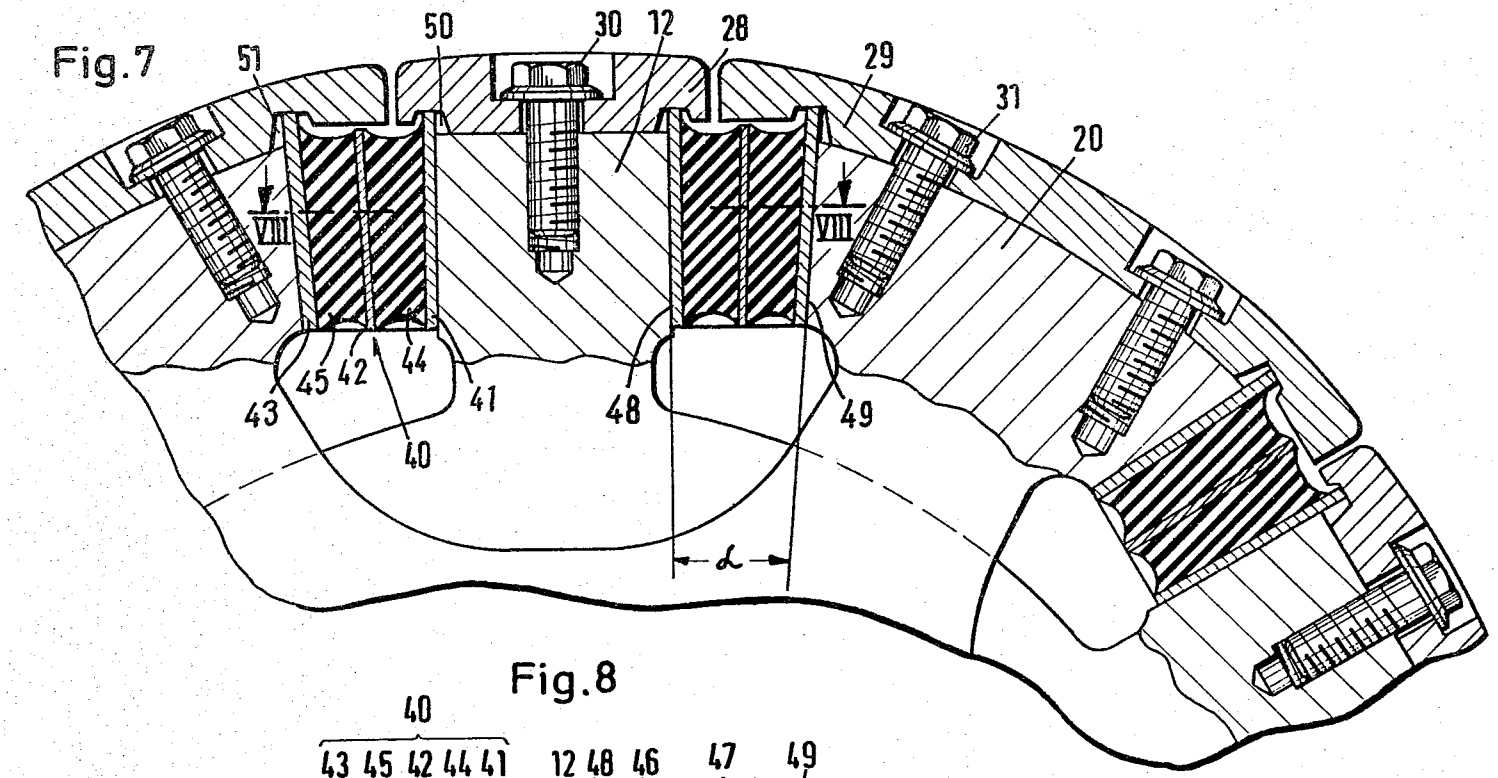
FIG. 7 is a sectional view similar to FIG. 3 and illustrating an alternative embodiment of the elastically yieldable elements.
Figure 8:
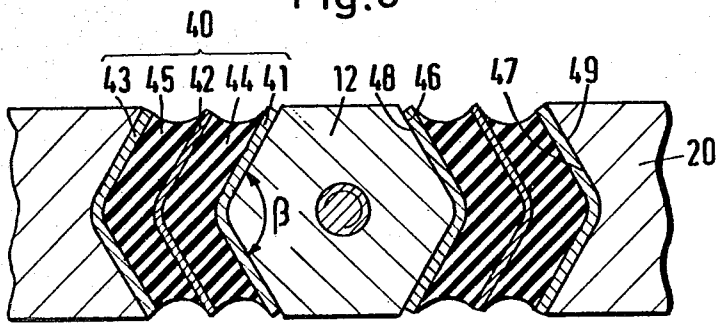
FIG. 8 is a sectional view taken along the line VIII—VIII of FIG. 7.

A further alternative construction of the elastically yieldable elements is illustrated in FIGS. 7 and 8, namely, the blocks 40 which are arranged in pairs and have a substantially V-shaped cross section. They each consist of an inner, intermediate and outer metal part 41, 42 and 43 and of rubber parts 44 and 45 which are vulcanized therebetween. The inner surfaces 46 of the two legs of the "V" engage correspondingly shaped surfaces 48 on the pins 12, and the outer surfaces 47 of such legs engage suitably shaped surfaces 49 provided on the arms 20. Cover plates 28 abnd 29 are mounted on the outer end surfaces of the pins 12 and the arms 20 by screws 30 and 31. The means needed for securing the screws against an independent loosening, for example safety sheets, are known and therefore not illustrated. To achieve different resiliency characteristics, the angle $\beta$ (FIG. 8) between the legs of the "V" can be varied and/or the metal parts 41, 42 and 43 can each be provided with a different angle $\beta$. Also, the center metal part 42 can be eliminated and a single rubber part provided, similar to the embodiment of FIG. 6. On the other hand, it is also possible to provide an intermediate metal part in the embodiment according to FIG. 6.

The inner metal part 41 and outer metal part 43 project into suitably positioned grooves 50 and 51 in the cover plates 28 and 29, respectively. This prevents the blocks 40, in the event of extraordinary operating conditions which cause the initial tension to drop to a value of zero, from being moved from their normal position, for example through the urging of centrifugal force.

The surfaces 48 and 49 are inclined at an angle $\alpha$ with respect to one another and the blocks 40 are designed wedge-shaped at the angle $\alpha$. With this measure, the rubber blocks can easily be inserted in a radial direction during assembly and it is possible to produce the necessary initial tension without complicated devices, in other words, with only the cover plates 28 and 29 or equivalent parts. The degree of initial tension is determined by the extent to which the blocks 40 dimensionally exceed the distance between the surfaces 48 and 49. Both dimensions can be selected during design and manufacture to produce the desired initial tension. What is said here with respect to the angle $\alpha$, with respect to the initial tension, and with respect to the grooves in the cover plates is also true for the earlier described blocks 32 (FIG. 6).

The invention is not limited to the preferred embodiments described and illustrated in the figures. For example, other gear arrangements such as a further gearing step are possible, the parts of the elastic couplings can be designed differently, and so forth. The patent protection includes such modifications.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A double-axle drive for rail vehicles, comprising:

rotatably supported first and second lontigudinally spaced tranversely wheeled axles;

a rotatably supported hollow shaft surrounding each axle;

a drive motor located between said axles having a drive shaft at respective ends;

gear means between each of said drive shafts and said hollow shafts at the respective ends of said motor to rotate said hollow shafts upon rotation of said drive shafts;

elastic coupling means connected adjacent each end of said hollow shaft to each first and second axle to rotate each of said axles, elastic coupling means comprising plural circumferentially spaced pin means secured to one of said hollow shaft and said axle with the axes thereof projecting radially, means defining plural circumferentially spaced arms secured to the other of said hollow shaft and said axle, said arms extending radially and being oriented in the circumferential spacing between said pin means, each said pin means and said arm having oppositely facing, circumferentially facing surfaces thereon, opposing circumferentially facing surfaces on mutually adjacent arms being located on opposite sides of a pin means located therebetween, the size of said pin means being smaller than the size of the circumferential distance between said opposing circumferentially facing surfaces to define a space therebetween, and elastically yieldable elements received in said space between said pin means and said opposing circumferentially facing surfaces, said elastically yieldable elements being fixedly secured between said pin means and each of said opposing circumferentially facing surfaces, the planes of said oppositely circumferentially facing surfaces on said pin means and said opposing circumferentially facing surfaces on mutually adjacent arms being angularly related at an acute angle to the axis of an associated one of said axles, and further being inclined at an acute angle to each other, and the planes of the oppositely facing surfaces on said elastically yieldably element also being inclined at an acute angle to each other so as to facilitate easy reception between mutually adjacent and opposing circumferentially facing surfaces on said pin means and said arm, said opposing circumferentially facing surfaces each having a V-shaped concave contour, said opposite sides of said pin means having a V-shaped convex contour, and said elastically yieldable elements being blocks arranged in opposing pairs and having two legs arranged in a V-shape, the inner surfaces of said two legs engaging said V-shaped surfaces of said pin means and the outer surfaces of said two legs engaging said V-shaped surfaces of said concave contours on said arms.

2. The double-axle drive according to claim 1, wherein said elastically yieldable elements each include a rubber part which is vulcanized between two metal parts, and wherein the engagement of the elastically yieldable elements with said pin means and said arms occurs through said metal parts.

3. The double-axle drive according to claim 2, wherein each said elastically yieldable element has at least two said rubber parts, between which is an intermediate metal part.

4. The double-axle drive according to claim 1, including a cover plate mounted on each radially outwardly facing surface of said pin means and said arms and project at least partially over the said elastically yieldable elements for securing said elastically yieldable elements against radial movement.

* * * * *